US012134945B2

(12) United States Patent
Decuir et al.

(10) Patent No.: US 12,134,945 B2
(45) Date of Patent: Nov. 5, 2024

(54) FRANGIBLE DISK SUB, METHOD AND SYSTEM

(71) Applicant: Baker Hughes Oilfield Operations LLC, Houston, TX (US)

(72) Inventors: Brandon Decuir, Houston, TX (US); Donavan Brown, Houston, TX (US); Nicholas S. Conner, Cypress, TX (US); Edward J. Kossa, Huffman, TX (US); Frank Maenza, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/171,890

(22) Filed: Feb. 21, 2023

(65) Prior Publication Data

US 2024/0279994 A1 Aug. 22, 2024

(51) Int. Cl.
*E21B 23/04* (2006.01)
*E21B 34/06* (2006.01)
*E21B 33/12* (2006.01)

(52) U.S. Cl.
CPC ..... *E21B 23/04* (2013.01); *E21B 34/063* (2013.01); *E21B 33/12* (2013.01)

(58) Field of Classification Search
CPC ..... E21B 23/04
See application file for complete search history.

(56) References Cited

U.S. PATENT DOCUMENTS 7,712,521 B2 5/2010 Sorensen
7,806,189 B2 10/2010 Frazier
8,322,448 B2 12/2012 Brandsdal
8,397,813 B2 * 3/2013 Brandsdal ..... E21B 33/134 166/299
9,222,322 B2 * 12/2015 Brandsdal ..... E21B 33/12
9,441,446 B2 9/2016 Fripp et al.
9,593,542 B2 3/2017 Getzlaf et al.
9,739,114 B2 8/2017 Frazier
(Continued)

FOREIGN PATENT DOCUMENTS

WO 2020197413 A1 10/2020

OTHER PUBLICATIONS

Notification of Transmittal of the International Search Report and the Written Opinion of the International Searching Authority, or the Declaration; PCT/US2024/016681; Maild ate: Jun. 18, 2024; 11 pages.

*Primary Examiner* — Steven A MacDonald
(74) *Attorney, Agent, or Firm* — CANTOR COLBURN LLP

(57) ABSTRACT

A frangible disk sub including a housing, a break mechanism disposed in the housing a carrier movably disposed in the housing, a frangible disk supported by the carrier and movable with the carrier into contact with the break mechanism, and a release mechanism restraining movement of the carrier until a threshold load is exceeded. A method for rupturing a frangible disk including exceeding a threshold load with on the sub, releasing the release mechanism, moving the carrier and the frangible disk toward and into contact with the break mechanism, and rupturing the frangible disk with the break mechanism. A borehole system including a borehole in a subsurface formation, a string in the borehole, and a frangible disk sub disposed within or as a part of the string.

20 Claims, 11 Drawing Sheets

(56) References Cited

U.S. PATENT DOCUMENTS 10,316,626 B2 6/2019 Keshishian et al.
10,465,445 B2 11/2019 Getzlaf et al.
10,655,413 B2 * 5/2020 Brandsdal ..... E21B 34/063
10,871,053 B2 12/2020 Frazier
10,883,314 B2 1/2021 Getzlaf et al.
10,883,328 B2 1/2021 Brandsdal
10,934,802 B2 3/2021 Brandsdal
10,989,013 B1 4/2021 Helms et al.
10,995,583 B1 5/2021 Helms et al.
11,098,556 B2 8/2021 Frazier
11,105,166 B2 8/2021 Yuan et al.
11,142,994 B2 10/2021 Yuan et al.
11,149,522 B2 * 10/2021 Brandsdal ..... E21B 33/1208
11,332,999 B1 * 5/2022 Eriksen ..... E21B 33/1208
11,441,382 B1 * 9/2022 Eriksen ..... E21B 34/102
2011/0000663 A1 * 1/2011 Brandsdal ..... E21B 33/134
166/178
2012/0125631 A1 * 5/2012 Entchev ..... E21B 33/12
166/376
2016/0060998 A1 * 3/2016 Hiorth ..... E21B 33/1208
166/192
2018/0371869 A1 * 12/2018 Kellner ..... E21B 21/10
2019/0017345 A1 * 1/2019 Brandsdal ..... E21B 34/063
2019/0032448 A1 * 1/2019 Bjørgum ..... E21B 34/063
2019/0352994 A1 11/2019 Giroux
2019/0352995 A1 11/2019 Giroux et al.
2020/0048987 A1 2/2020 Roessler et al.
2020/0200516 A1 * 6/2020 Zemla ..... F42D 1/045
2020/0332601 A1 10/2020 Getzlaf et al.
2020/0408065 A1 * 12/2020 Palmer ..... E21B 34/142
2021/0040816 A1 * 2/2021 Hiorth ..... E21B 34/063
2021/0108476 A1 * 4/2021 Brandsdal ..... E21B 33/1208
2021/0148184 A1 5/2021 Helms et al.
2021/0164324 A1 6/2021 Helms et al.
2021/0355776 A1 11/2021 Yuan et al.
2021/0404278 A1 12/2021 Harris et al.
2022/0034194 A1 2/2022 Brandsdal et al.
2022/0251922 A1 * 8/2022 Hiorth ..... E21B 34/063
2023/0089352 A1 * 3/2023 Eriksen ..... E21B 34/063
166/378
2023/0193718 A1 * 6/2023 Eriksen ..... E21B 34/063
166/192
2023/0243229 A1 * 8/2023 Eriksen ..... E21B 33/1208
166/179
2023/0243230 A1 * 8/2023 Eriksen ..... E21B 33/1208
166/179

* cited by examiner

FRANGIBLE DISK SUB, METHOD AND SYSTEM

BACKGROUND

In the resource recovery and fluid sequestration industries there are times when a temporary barrier is needed. It is desirable for the barrier to be completely removed when its function is no longer needed. Frangible disks are useful for this duty but require relatively high applied pressures to cause their rupture. The high pressures either imperil other wellbore components or necessitate the construction of the wellbore with components that withstand higher pressures than would otherwise be necessary thereby increasing costs in constructing the wellbore. Alternate configurations that avoid these drawbacks would be welcome in the art.

SUMMARY

An embodiment of a frangible disk sub including a housing, a break mechanism disposed in the housing a carrier movably disposed in the housing, a frangible disk supported by the carrier and movable with the carrier into contact with the break mechanism, and a release mechanism restraining movement of the carrier until a threshold load is exceeded.

An embodiment of a method for rupturing a frangible disk including exceeding a threshold load with on the sub, releasing the release mechanism, moving the carrier and the frangible disk toward and into contact with the break mechanism, and rupturing the frangible disk with the break mechanism.

An embodiment of a borehole system including a borehole in a subsurface formation, a string in the borehole, and a frangible disk sub disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
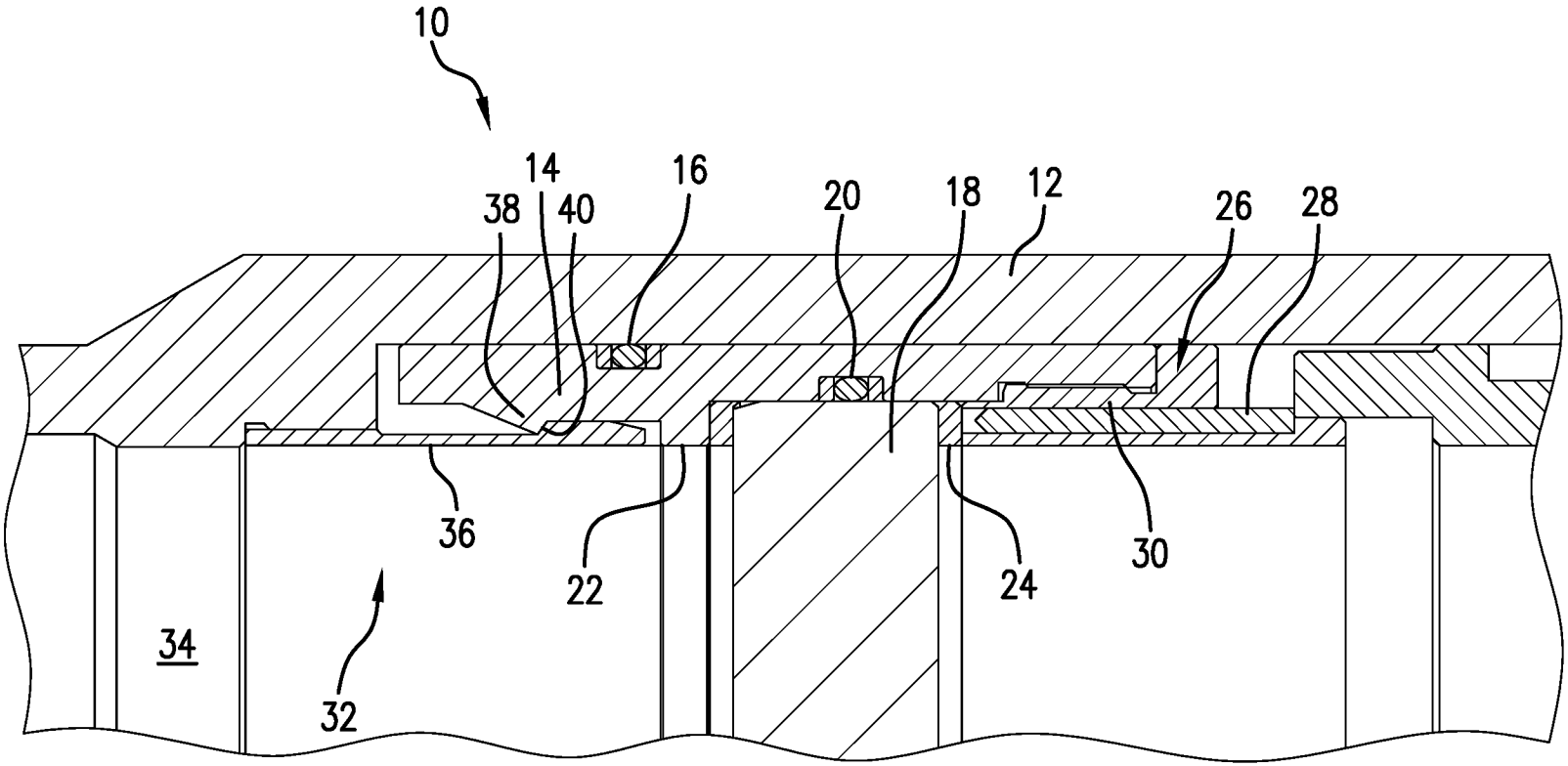
FIG. 1 is a cross section view of a first embodiment of a frangible disk sub as disclosed herein.

Referring to FIG. 1, a frangible disk sub 10 is illustrated. Sub 10 comprises a housing 12 wherein a disk carrier 14 is located and movably disposed. The carrier 14 includes a seal 16, which may be an o-ring, for example, that seals between the carrier 14 and the housing 12. The carrier 14 supports a frangible disk 18 and includes a seal 20 that provides for sealing between the carrier 14 and the frangible disk 18. Further, in embodiments, supports 22 and 24 are also included to avoid stress risers between the disk 18 and the carrier 14 causing premature rupture of the disk 18. These may be of any material softer than the material of the carrier 14. Adjacent the carrier 14 in the housing 12 is a break mechanism 26. The break mechanism 26 includes a hard point member 28 that is aligned with the disk 18 and not in direct contact therewith in a first position. The member 28 is supported by a member housing 30 and is in a fixed position relative to the housing 12. Upon movement of the carrier 14 toward the member 28, contact between member 28 and the disk 18 may be made and a load placed thereon to effect rupture of the disk 18. Movement of the carrier 14 is prevented by a release mechanism 32 that resists release of the carrier 14 until a threshold load, which may be pressure or a mechanical device or an energetic device, etc., that acts through an inside diameter 34 of the housing 12 on the disk 18 is exceeded. When the threshold load is exceeded, the mechanism 32 releases the carrier 14 and the carrier 14 along with disk 18 moves toward and into contact with member 28. Loaded contact between disk 18 and member 28 initiates rupture of the disk 18.

Figure 2:
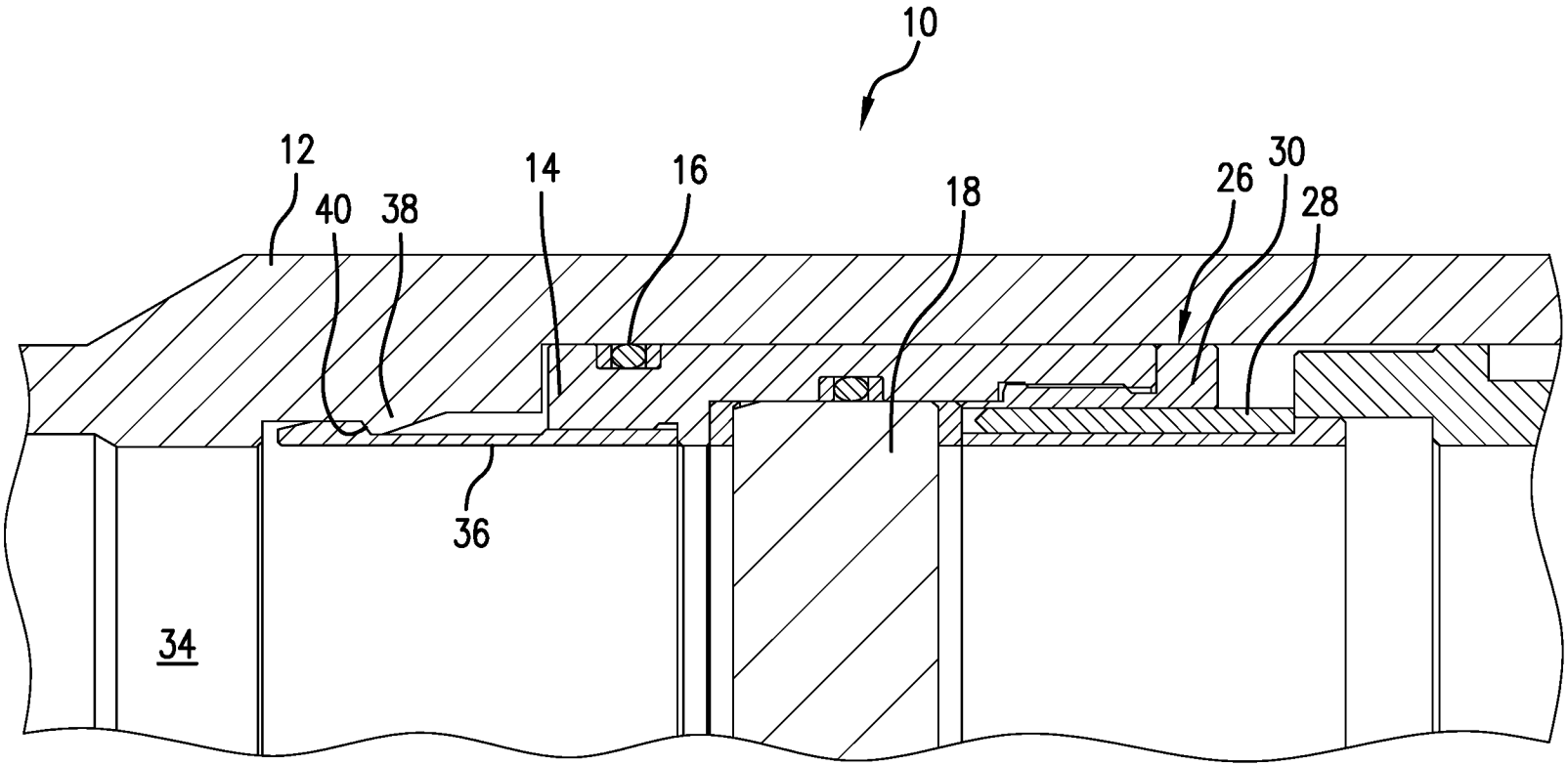
FIG. 2 is similar to FIG. 1 with some of its components reversed.

In the FIGS. 1 and 2 embodiments, the release mechanism includes a collet 36 and an engagement feature 38. The collet 36 may extend from the housing 12 (FIG. 1) or from the carrier 14 (FIG. 2) while the engagement feature 38 is located on the other of the carrier 14 or the housing 12. An angled face 40 of the engagement feature 38 and a stiffness of the collet 36 dictate the threshold pressure at which the collet 36 will deflect under the load and the release mechanism 32 releases.

Figure 3:
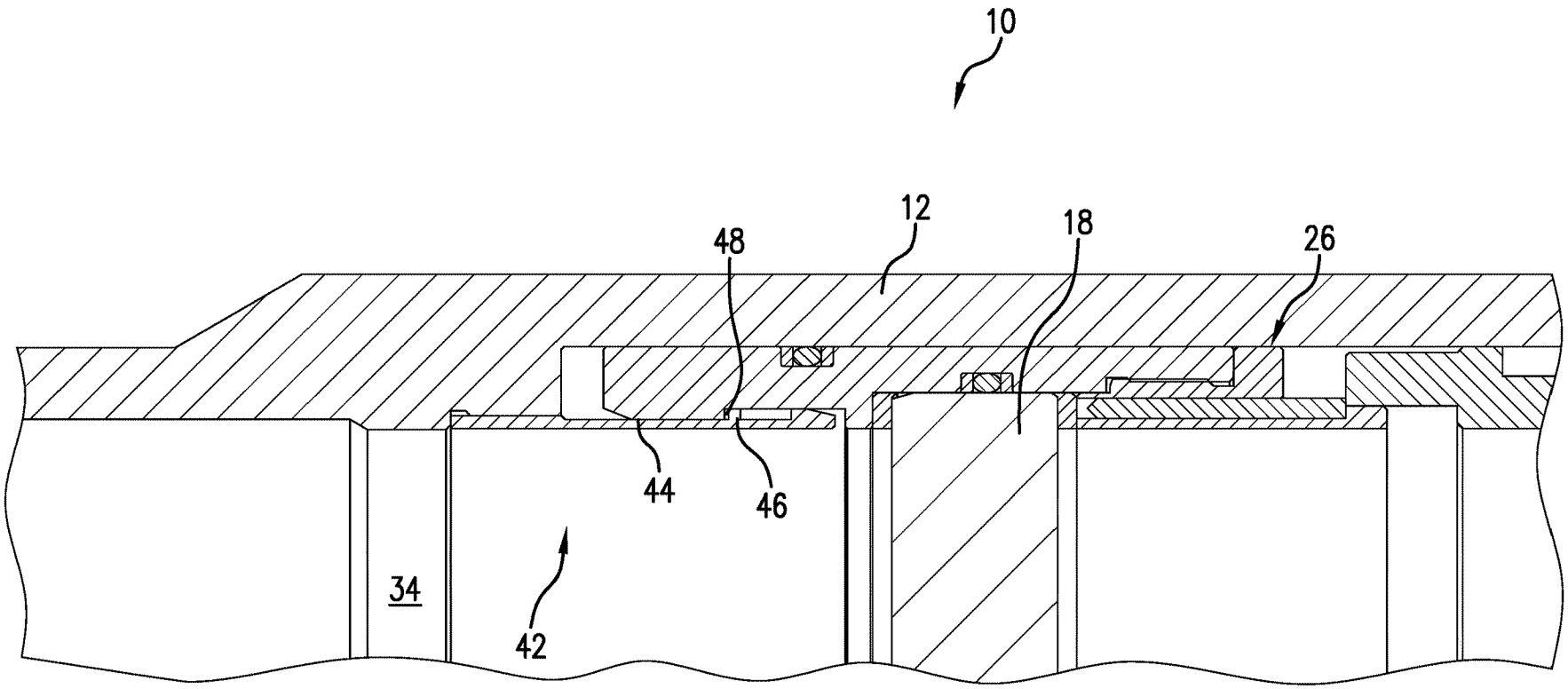
FIG. 3 is a cross section view of a second embodiment of a frangible disk sub as disclosed herein.
Figure 4:
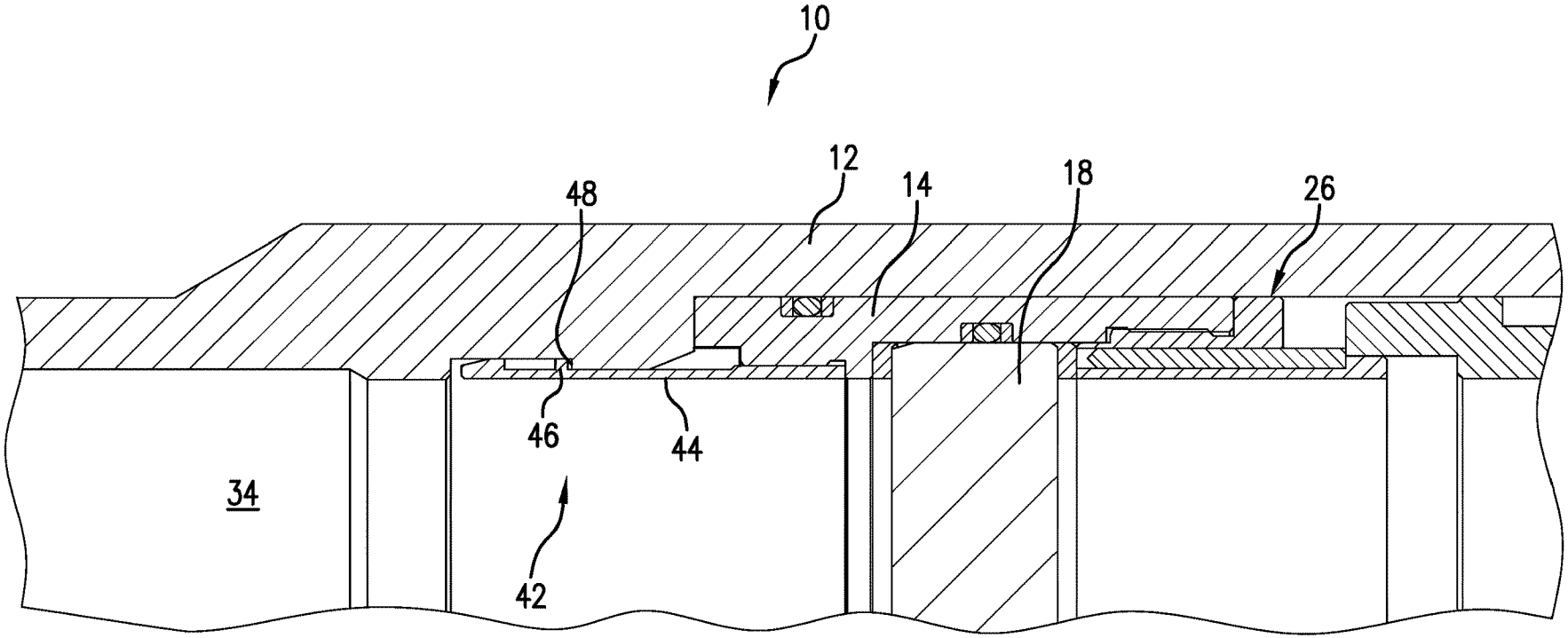
FIG. 4 is similar to FIG. 3 with some of its components reversed.

Referring to FIGS. 3 and 4, a similar frangible disk sub 10 is illustrated with a different release mechanism 42. Mechanism 42 is a collet 44 with an integral shear tab 46. The shear tab 46 is in contact with a shoulder 48 that may be on the carrier 14 (FIG. 3) or the shoulder 48 may be on the housing 12 (FIG. 4). In some embodiments, the shoulder 48 may be orthogonal to a longitudinal extent of the sub 10 while in other embodiments the shoulder may only be substantially orthogonal to the sub 10. The release tab is subject to the same loading from pressure through the ID 34 of housing 12 as the embodiment of FIGS. 1 and 2. At a predetermined threshold load, the shear tab 46 will shear and the carrier 14 will move. The disk 18 as in the previous embodiment will come into loaded contact with the hard point member 28 and rupture of the disk 18 will similarly occur. It will be appreciated that as in the previous embodiment the orientation of the release member 42 may be reversed without detrimental effect.

Figure 5:
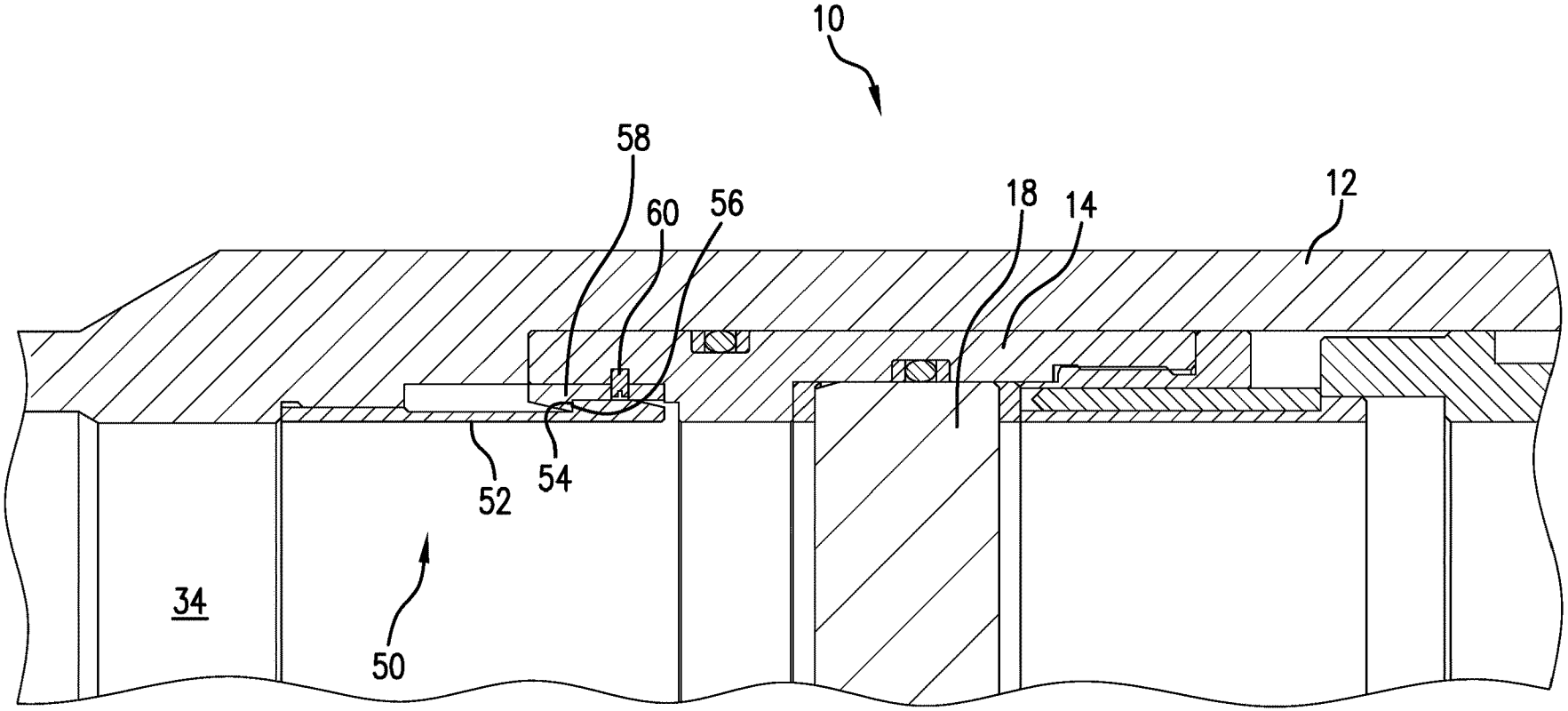
FIG. 5 is a cross section view of a third embodiment of a frangible disk sub as disclosed herein.
Figure 6:
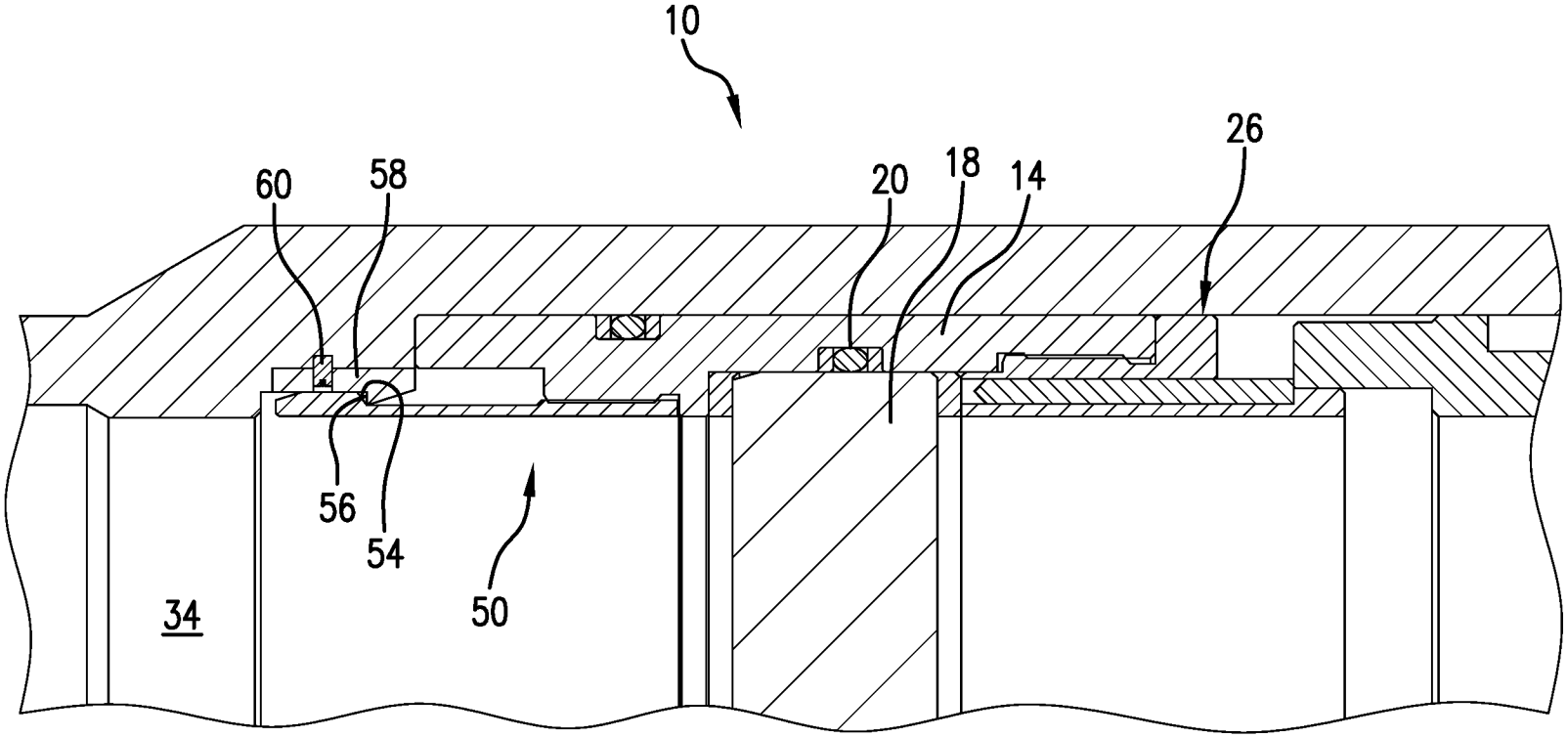
FIG. 6 is similar to FIG. 5 with some of its components reversed.

Referring to FIGS. 5 and 6, yet another embodiment of frangible disk sub 10 is illustrated. Again, the sub 10 is the same but for the release mechanism, which is designated release mechanism 50 in this embodiment. Mechanism 50 includes a collet 52 that like collet 44 is not intended to flex for release but rather only to flex during engagement at a manufacturing stage. Hence, the collet has an orthogonal or back angled engagement face 54 that engages a complementarily oriented shoulder 56 of a ring 58 that is releasably connected to one of the housing 12 or the carrier 14. As shown, ring 58 is secured with a shear member 60, which may be a shear screw, a shear pin, an adhesive, etc. When pressure in ID 34 is increased to a threshold pressure, the shear screw 60 will shear and allow the carrier 14 to move as it does in the foregoing embodiments, with the same results. Also as in the foreign embodiments, the components of the release mechanism 50 may be reversed and function in the same manner.

Figure 7:
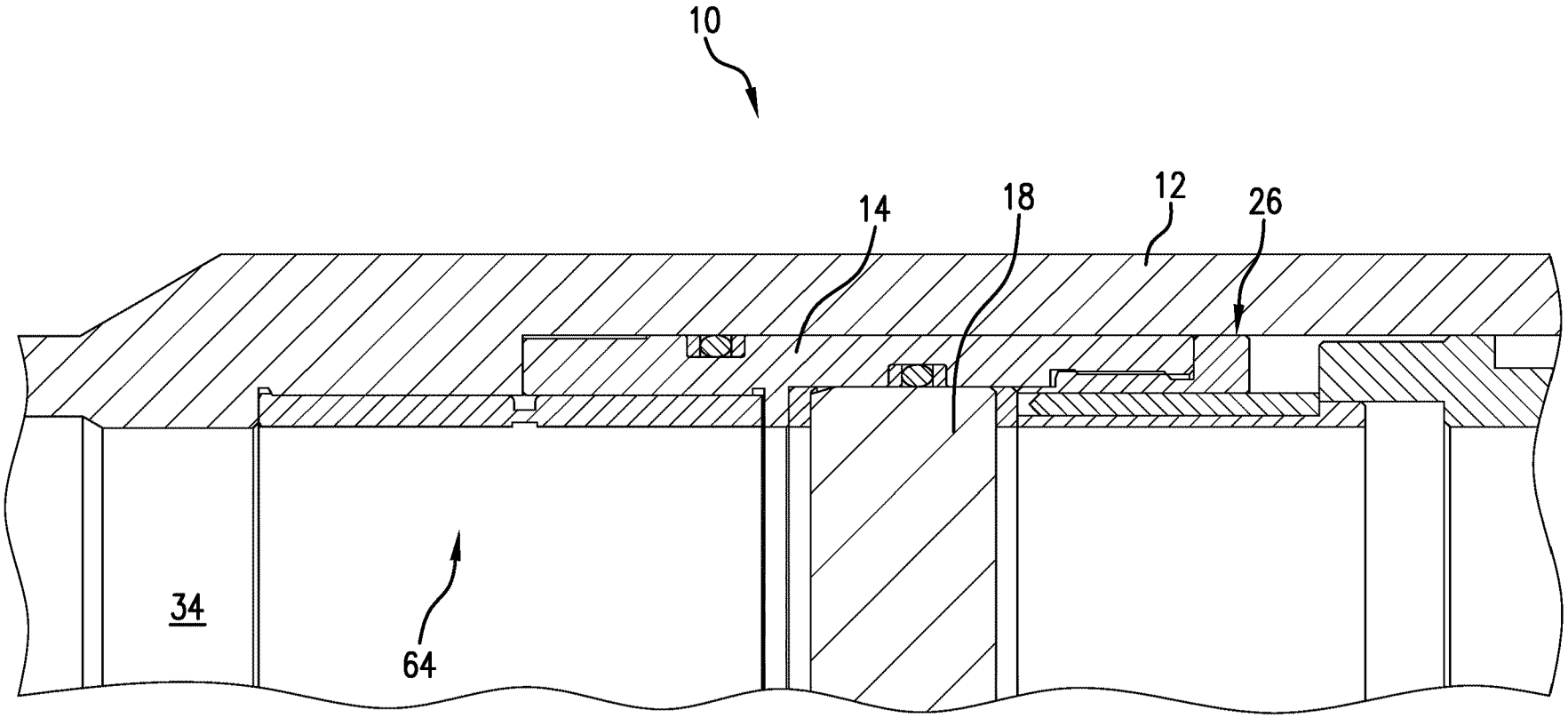
FIG. 7 is a cross section view of a fourth embodiment of a frangible disk sub as disclosed herein.

Referring to FIG. 7, another embodiment of sub 10 is illustrated, which like the previous embodiments features a different release mechanism 64. Release mechanism 64 comprises a tensile ring 66 that spans between the housing 12 and the carrier 14 to hold the carrier 14 in place relative to the housing 12 until the pressure in ID 34 exceeds the threshold pressure. When the threshold is exceeded the tensile ring 66, which may or may not include a specific a tensile area 68, that may be a weakened area or may be a reduced dimension area, will part, thereby releasing the carrier 14 to move with the pressure resulting in the disk 18 experiencing a loaded contact with the break mechanism 26 and rupturing the disk 18.

Figure 8:
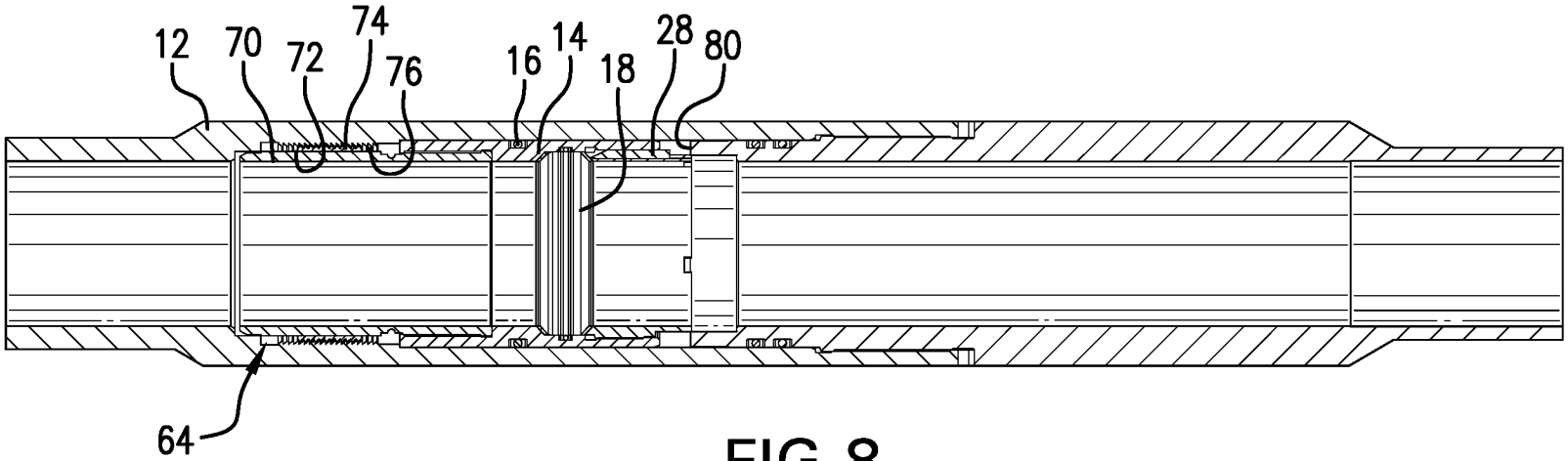
FIGS. 8-10 are cross section views of a fifth embodiment of a frangible disk sub as disclosed herein in three positions.
Figure 9:
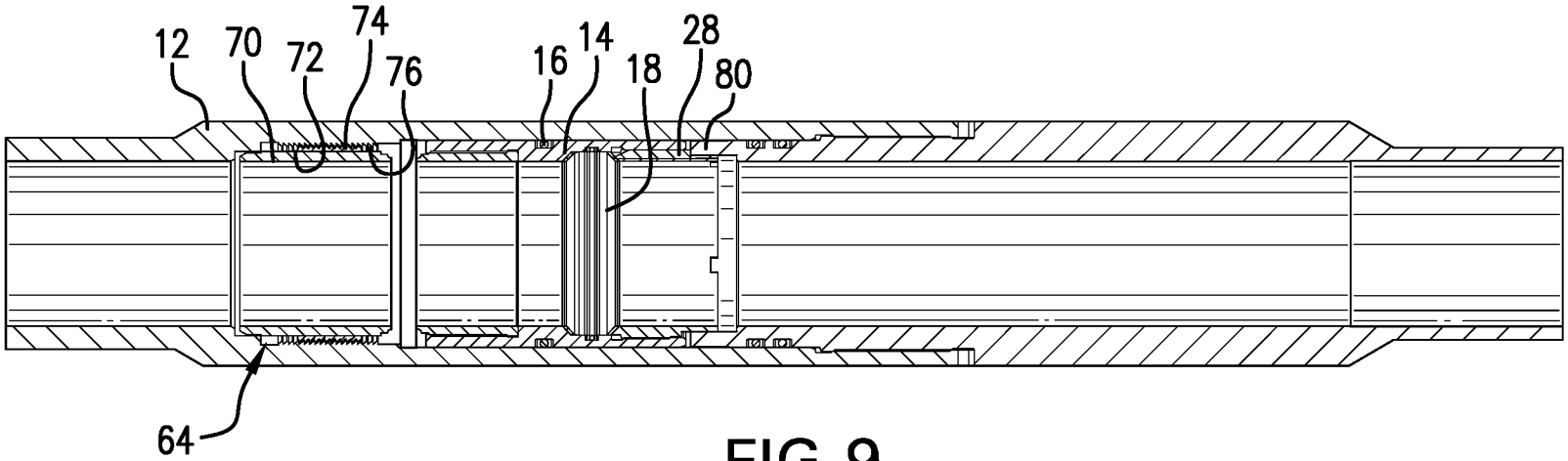
Figure 10:
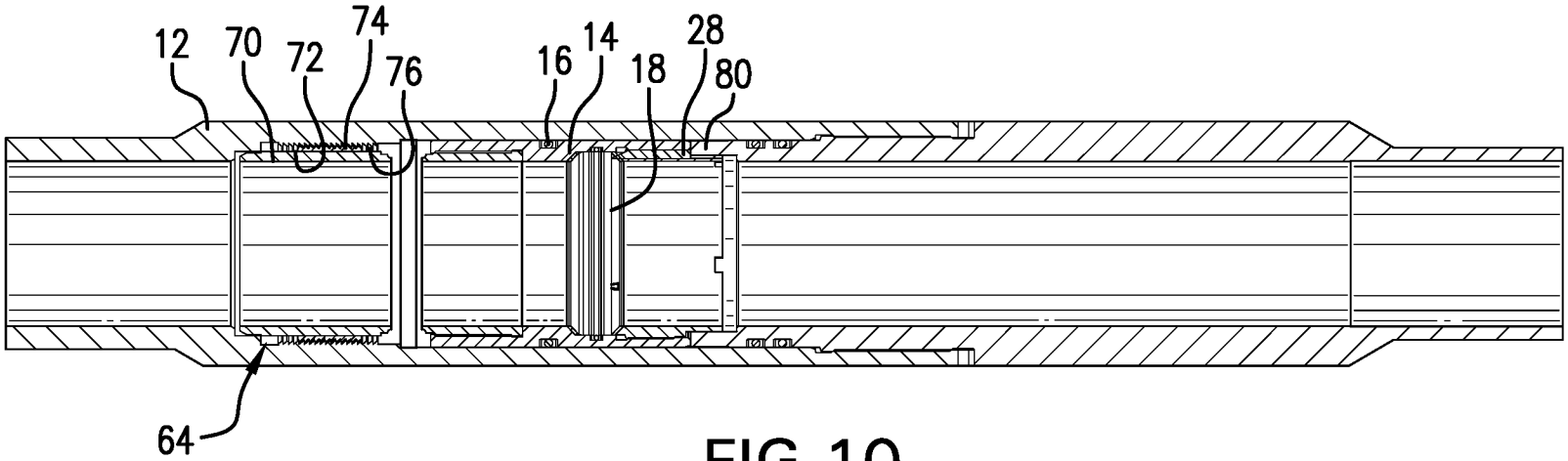

Referring to FIGS. 8-10, another embodiment is illustrated in three positions. In FIG. 8, a run-in position is illustrated; in FIG. 9 a break initiation position is illustrated; and in FIG. 10 a fully activated position is illustrated. While the components are in some cases similar to those discussed above, some are distinct. The distinct components are addressed These are the features of a tensile ring 70 (though this is still a tensile release mechanism so its overall numeral remains 64) and the housing of the hard point member of prior embodiments. The hard point member 28 is similar but it is supported by the carrier 14 rather than any member housing of the previous embodiments. This saves a component during manufacture but the function of the arrangement remains the same. The tensile ring 70 is provided a new numeral for identification vs the numeral 66 for the prior embodiment because the ring 70 also includes a wicker 72 on an outside diameter surface of the ring 70. The wicker 72 is in communication with a body lock ring (BLR) 74 which is also in communication with an anchor wicker 76 at an inside diameter surface of the housing 12. The addition of the BLR 74 provides a significant benefit during assembly of the frangible disk sub. Specifically, it will be appreciated that in each embodiment, a seal 16 is disposed between the carrier 14 and the housing 12. It has been determined that seal 16 can be worn by threading the sub together due to the seal 16 rotating along the inside surface of the housing 12. In order to overcome the drawback, the BLR and associated wickers allows assembly of the sub simply by pushing the components together. Rotation as in threading is not needed because the BLR 74 will provide the anchoring function that threads might have on the ring 70. Of course, it is possible to use threads to secure the ring 70 and that method is contemplated but wear of the seal 16 would be anticipated and hence the alternative of the BLR 74 is also disclosed.

In operation, the embodiment of FIGS. 8-10 operate similarly to that of FIG. 7. A hydraulic load is placed upon the disk 18 from the left of the figure. This causes the carrier 14 and disk 18 to want to move to the right of the figure but they are constrained by the ring 70 and the BLR 74 to the housing 12. When the pressure reaches a threshold pressure, a tensile area 78 will part and allow the movement of the carrier 14 and disk 18 whereby the hard point member 28 lands against a shoulder 80 and begins to bear against the disk 18 to initiate rupture (see FIG. 9). By FIG. 10, the movement of the carrier 14 and disk 18 is complete and the member 28 has caused complete rupture of the disk 18.

In each of the embodiments discussed above it is to be appreciated that the release mechanism 32, 42, 50, 64 is uphole of the frangible disk 18, which tends to keep the release mechanism debris free during its intended operational lifetime.

Figure 11:
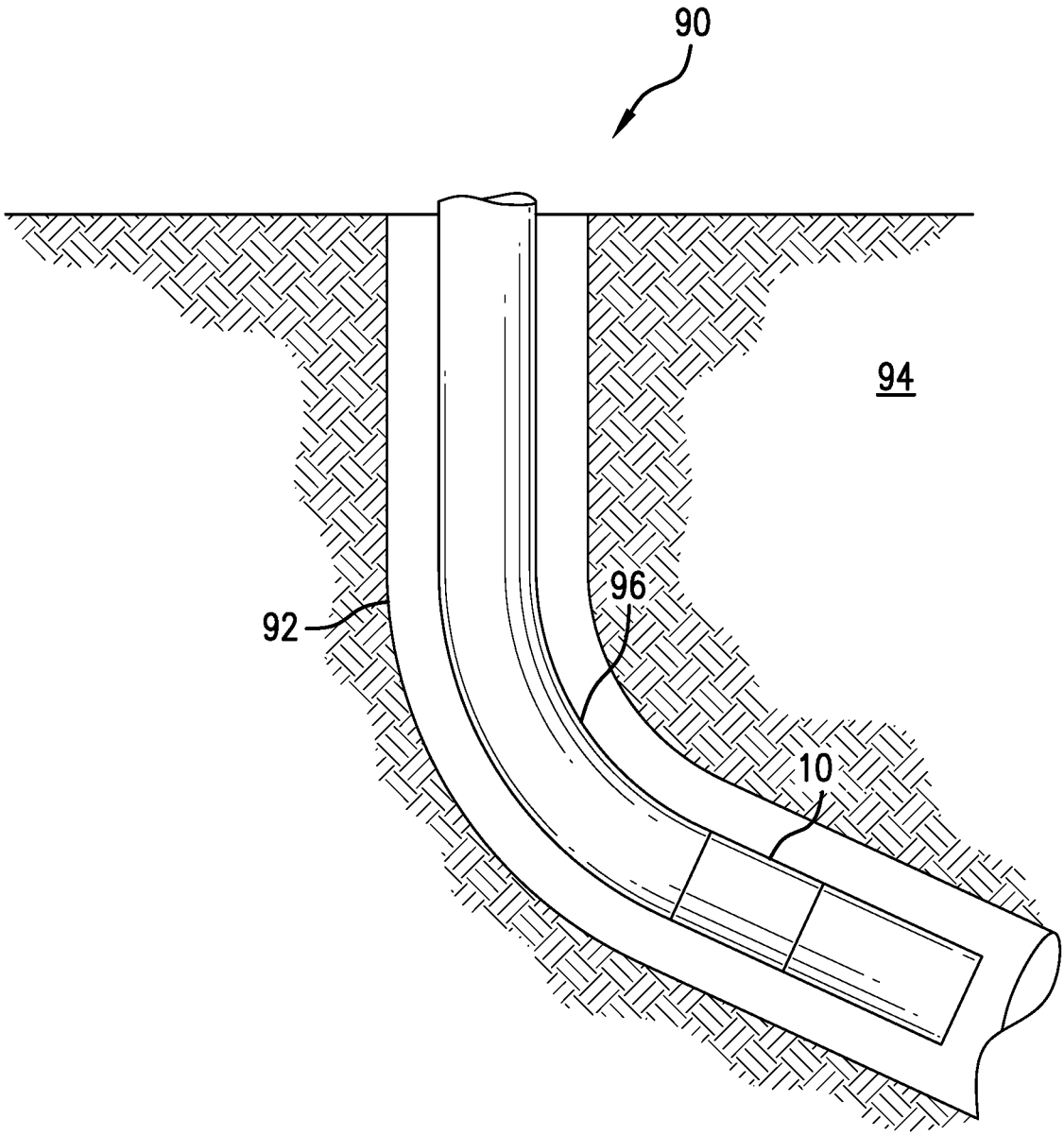
FIG. 11 is a view of a borehole system including a frangible disk sub as disclosed herein.

Referring to FIG. 11, a borehole system 90 is schematically illustrated. The system 90 comprises a borehole 92 in a subsurface formation 94. A string 96 is disposed within the borehole 92. An embodiment of the frangible disk sub 10 is disposed within or as a part of the string 96.

Set forth below are some embodiments of the foregoing disclosure:

Embodiment 1: A frangible disk sub including a housing, a break mechanism disposed in the housing a carrier movably disposed in the housing, a frangible disk supported by the carrier and movable with the carrier into contact with the break mechanism, and a release mechanism restraining movement of the carrier until a threshold load is exceeded.

Embodiment 2: The sub as in any prior embodiment, wherein the break mechanism includes a member housing and a hard point member disposed therein, the hard point member being aligned with the frangible disk.

Embodiment 3: The sub as in any prior embodiment, wherein carrier is movably sealed to the housing.

Embodiment 4: The sub as in any prior embodiment, wherein the disk is sealed to the carrier.

Embodiment 5: The sub as in any prior embodiment, wherein the release mechanism comprises a collet.

Embodiment 6: The sub as in any prior embodiment, wherein the release mechanism comprises a feature to engage the collet.

Embodiment 7: The sub as in any prior embodiment, wherein the feature includes an angled face.

Embodiment 8: The sub as in any prior embodiment, wherein the feature includes an orthogonal face.

Embodiment 9: The sub as in any prior embodiment, wherein the collet releases by deflection at the threshold load.

Embodiment 10: The sub as in any prior embodiment, wherein the collet includes a shear tab.

Embodiment 11: The sub as in any prior embodiment, wherein the release mechanism comprises a ring having a shoulder for engagement with a collet, the ring being secured to one of the housing or the carrier by a shear member.

Embodiment 12: The sub as in any prior embodiment, wherein the shoulder includes a back angle.

Embodiment 13: The sub as in any prior embodiment, wherein the release mechanism comprises a tensile ring secured to the housing and the carrier.

Embodiment 14: The sub as in any prior embodiment, wherein the tensile ring is secured with a body lock ring.

Embodiment 15: The sub as in any prior embodiment, wherein the tensile ring includes a tensile area.

Embodiment 16: A method for rupturing a frangible disk including exceeding a threshold load with on the sub as in any prior embodiment, releasing the release mechanism, moving the carrier and the frangible disk toward and into contact with the break mechanism, and rupturing the frangible disk with the break mechanism.

Embodiment 17: The method as in any prior embodiment wherein the releasing is deflecting a collet.

Embodiment 18: The method as in any prior embodiment wherein the releasing is shearing a shear tab on a collet.

Embodiment 19: The method as in any prior embodiment wherein the releasing is shearing a shear member of a ring secured by the member to one of the housing or the carrier.

Embodiment 20: The method as in any prior embodiment wherein the releasing is parting a tensile ring.

Embodiment 21: A borehole system including a borehole in a subsurface formation, a string in the borehole, and a frangible disk sub as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A frangible disk sub comprising:
a housing;
a break mechanism disposed in the housing;
a carrier movably disposed in the housing;
a frangible disk mounted in the carrier and movable with the carrier into contact with the break mechanism; and
a release mechanism restraining movement of the carrier until a threshold load is exceeded, the release mechanism comprising a collet finger having a collet head and the collet finger including a shear tab extending radially from the collet finger.

2. The sub as claimed in claim 1, wherein the break mechanism includes a member housing and a hard point member disposed therein, the hard point in member being aligned with the frangible disk.

3. The sub as claimed in claim 1, wherein carrier is movably sealed to the housing.

4. The sub as claimed in claim 1, wherein the disk is sealed to the carrier.

5. The sub as claimed in claim 1, wherein the release mechanism comprises a collet.

6. The sub as claimed in claim 5, wherein the release mechanism comprises a feature to engage the collet.

7. The sub as claimed in claim 6, wherein the feature includes an angled face.

8. The sub as claimed in claim 6, wherein the feature includes an orthogonal face.

9. The sub as claimed in claim 5, wherein the collet releases by deflection at the threshold load.

10. A method for rupturing a frangible disk comprising:
exceeding a threshold load with on the sub as claimed in claim 1;
releasing the release mechanism;
moving the carrier and the frangible disk toward and into contact with the break mechanism; and
rupturing the frangible disk with the break mechanism.

11. The method as claimed in claim 10 wherein the releasing is deflecting a collet.

12. The method as claimed in claim 10 wherein the releasing is shearing the shear tab on the collet finger.

13. A method for rupturing a frangible disk comprising:
exceeding a threshold load with on the sob as claimed in claim 1;
releasing the release mechanism;
moving the carrier and the frangible disk toward and into contact with the break mechanism; and
rupturing the frangible disk with the break mechanism,
wherein the releasing is shearing a shear member of a ring secured by the member to one of the housing or the carrier.

14. A method for rupturing a frangible disk comprising:
exceeding a threshold load with on the sub as claimed in claim 1;
releasing the release mechanism,
moving the carrier and the frangible disk toward and into contact with the break mechanism; and
rupturing the frangible disk with the break mechanism,
wherein the releasing is parting a tensile ring.

15. A borehole system comprising:
a borehole in a subsurface formation;
a string in the borehole; and
a frangible disk sub as claimed in claim 1 disposed within or as a part of the string.

16. A frangible disk sub comprising:
a housing;
a break mechanism disposed in the housing;
a carrier movably disposed in the housing;
frangible disk mounted in the carrier and movable with the carrier into contact with the break mechanism; and
a release mechanism restraining movement of the carrier until a threshold load is exceeded wherein the release mechanism comprises a ring having a shoulder for engagement with a collet, the ring being secured to one of the housing or the carrier by a shear member.

17. The sub as claimed in claim 16, wherein the shoulder includes a back angle.

18. A frangible disk sub comprising:
a housing;
a break mechanism disposed in the housing;
a carrier movably disposed in the housing;

a frangible disk mounted in the carrier and movable with the carrier into contact with the break mechanism; and a release mechanism restraining movement of the carrier until a threshold load is exceeded wherein the release mechanism comprises a tensile ring secured to the housing and the carrier.

19. The sub as claimed in claim 18, wherein the tensile ring is secured with a body lock ring.

20. The sub as claimed in claim 18, wherein the tensile ring includes a tensile area.

* * * * *